US006099268A

United States Patent [19]

Pressel

[11] Patent Number: 6,099,268

[45] Date of Patent: Aug. 8, 2000

[54] PNEUMATIC COMPRESSOR SYSTEM

[76] Inventor: Hans-Georg G. Pressel, P.O. Box 460413, Glendale Sta., Denver, Colo. 80246

[21] Appl. No.: 09/162,714

[22] Filed: Sep. 29, 1998

[51] Int. Cl.[7] ..... F04B 17/00; F04B 53/00

[52] U.S. Cl. ..... 417/360; 417/234

[58] Field of Search ..... 417/360, 362, 417/363, 234

[56] References Cited

U.S. PATENT DOCUMENTS

| | | | |
|---|---|---|---|
| 2,964,236 | 12/1960 | Kasper | 417/363 |
| 4,810,169 | 3/1989 | Kranzle | 417/63 |
| 5,404,614 | 4/1995 | Stephens | 15/327.2 |
| 5,606,769 | 3/1997 | Tomasiak et al. | 15/327.6 |

*Primary Examiner*—Henry C. Yuen
*Assistant Examiner*—Arnold Castro
*Attorney, Agent, or Firm*—John E. Reilly

[57] ABSTRACT

An air compressor system is characterized by being made up of a swash plate type of air compressor which is capable of delivering pressures into the range of 200 p.s.i. and is selectively and interchangeably insertable into holding tanks of different sizes and configurations for different specific applications and wherein the holding tanks are also characterized by having inner tank liners and a connecting valve between the compressor and liner to deliver pressurized air from the compressor into the storage compartment defined by the liner within the tank; and the tank and its liner can serve as a self-contained source of pressurized air which can be selectively discharged as required so that the compressor itself may be disconnected from the tank and successively connected to a number of different or additional tanks.

15 Claims, 7 Drawing Sheets

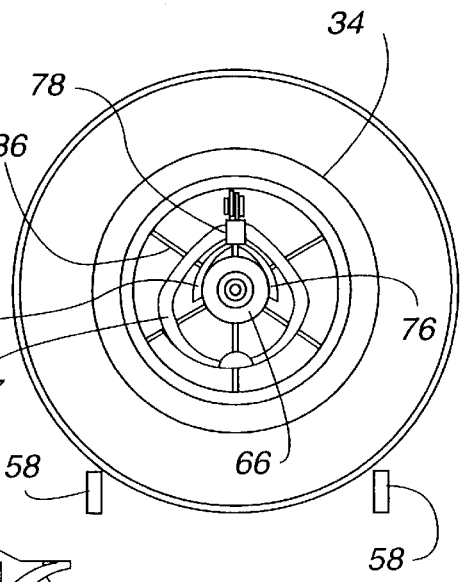
Fig. 3
Fig. 4
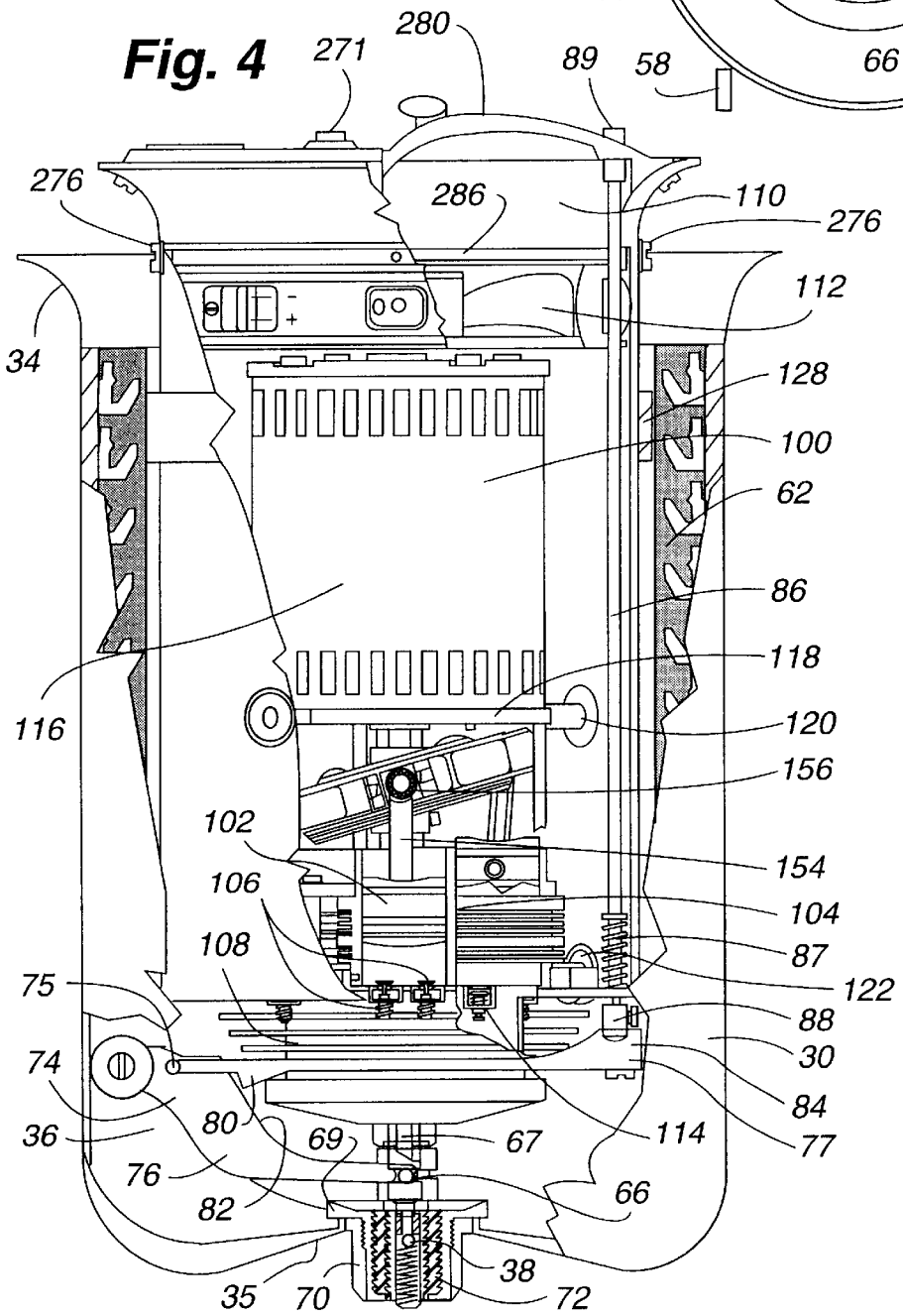

258
254
250
260
244
246
242
232
234
106
144
222
230
256
224
224
236
124
106'
226
226
114'
224

PNEUMATIC COMPRESSOR SYSTEM

BACKGROUND OF THE INVENTION

This invention relates to air compressors; and more particularly relates to a novel and improved swash plate air compressor conformable for use with air tanks of varying sizes and configurations which can be positively but releasably attached to each air tank according to the intended application.

In the past, air compressors have borrowed from conventional combustion engine designs while reversing the typical energy cycle to convert mechanical energy into pneumatic energy. Indeed, most prior air compressors utilize conventional crankshaft technology to drive pistons and thus suffer numerous drawbacks relating to energy conversion, size and weight, as well as the noise associated with operation of such compressors.

With the advent of smaller motors, the size and weight of compressors have gradually been reduced, allowing portable compressors to be attached to relatively small air tanks. However, such portable compressors still typically rely on traditional crank shaft technology and thus trade power for size so that most portable compressors can not achieve substantial volume at high pressure within the attached air tank. Furthermore, even with their reduced size, such portable air compressors and their associated air tanks represent heavy, cumbersome assemblies which strain the definition of the term "portable."

A further drawback to current compressors is that the compressor is typically mated with a single air tank and can not be easily adapted to work with other air tanks. Thus, current portable compressors are often relegated to being used with small air tanks which may be too small to hold a useful volume of pressurized air for the required task. Similarly, larger non-portable air tanks are typically mated with large compressors which can not be easily moved.

Previously, efforts have been made to substitute swash plate technology for the more conventional crank shaft technology within air compressors. Swash plate compressors utilize a wobbling disk connected to a drive shaft to reciprocate the pistons within the air cylinders. Due to the relatively small size of most air compressors (at least in relation to the size of an internal combustion engine), the use of a wobble or swash plate to drive the pistons has led to increased efficiencies due to the decreased angle of the piston connecting rod which is attached to the swash plate and the mechanical flow of energy. In essence, the swash plate provides a truer reciprocating action for the piston rods than is possible with conventional crank shafts. This has led to the introduction of oil or lubricant-free compressors due to the reduced strain applied by the swash plate to the piston connecting rods which results in reduced friction between the pistons and cylinders.

However, these early swash plate compressors have failed to adequately address the added degree of motion which the swash plate imposes on the piston connecting rod in comparison to a traditional crank shaft. In essence, the wobbling motion of the swash plate causes a periphery of the swash plate to follow a wave-like or figure-8 pattern which results from the combination of a first arcuate motion of the swash plate periphery toward and away from the drive shaft and a second rolling motion of the swash plate periphery about an axis perpendicular to the drive shaft. To account for this figure-8 pattern, the end of the piston connecting rod which is connected to the swash plate must be free to move in two different directions (i.e., rotate about two different axes) to prevent over-stressing the piston rods. While some designs have attempted to provide for this freedom of movement by replacing traditional piston connecting rod, bearings and wrist pins with ball and socket connectors or other similar joints, these joints have failed to provide an adequate connection between the swash plate and the piston rod, particularly when the compressor is required to achieve high pressures or is operated over extended duty cycles. Specifically, prior swash plate compressors utilizing ball and socket connectors are typically not suitable to generate relatively high pressures (e.g., 90 p.s.i. and above) and are extremely susceptible to piston rod failure.

Representative of such prior swash plate compressors are those disclosed in U.S. Pat. No. 2,825,499 to Gibson et al., U.S. Pat. No. 4,495,855 to Murakami et al., U.S. Pat. No. 5,109,754 to Shaw, and U.S. Pat. No. 5,304,043 to Shilling, each of which use ball and socket connectors or similar swivel elements within the swash plate to engage the piston connecting rods. Other patents of interest include U.S. Pat. No. 4,734,013 to Valavaara, U.S. Pat. No. 5,127,314 to Swain, U.S. Pat. No. 2,956,845 to Wahlmark, and U.S. Pat. No. 2,412,316 to Campbell.

Therefore, a continuing need exists for a portable, lightweight, high-power air compressor system that overcomes the above and other limitations of prior art air compressors. A need also exists for an air compressor which can be selectively and interchanbeably utilized with different sizes and configurations of air tanks to accommodate the different needs of different end users. It is with respect to these and other background considerations, limitations and problems, that the present invention has evolved.

SUMMARY OF THE INVENTION

It is therefore an object of the present invention to provide for a novel and improved air compressor which is compact and highly efficient in operation.

It is another object of the present invention to provide for a novel and improved portable but lightweight, high pressure air compressor system which can be selectively utilized with different sizes and configurations of air tanks in an extremely efficient and unique manner; and specifically wherein the air compressor is insertable into an air tank having a high pressure chamber to receive air from the compressor with a separate air discharge associated with the tank for supplying pressurized air in different applications.

It is a further object of the present invention to provide in an air compressor system for a novel and improved air compressor of the swash plate type capable of achieving high pressures in the range of 175 p.s.i. for extended duty cycles without lubrication or excessive strain placed upon the piston connecting rods, bearings and cylinders of the compressor.

It is an additional object of the present invention to provide in an air compressor system for a unique suspension system capable of supporting a compressor within a tank liner in such a way as to minimize noise and the transmission of vibrations from the compressor into the tank; and specifically wherein the compressor is conformable for use with different air tanks in which the compressor is successively connected to each tank to deliver pressurized air thereto so that the tank itself can serve as a stand-alone source of pressurized air for various applications.

It is a still further object of the present invention to provide for a novel and improved air compressor system incorporating a unique suspension system within a tank liner for releasable connection and suspension of a high pressure but compact compressor therein so as to be capable of various applications in limited space conditions, all in a novel and improved manner.

In accordance with the present invention, there has been devised a novel and improved air compressor system which is selectively operable alone or in combination with one or more air tanks which cooperate with a tank liner to define an interior storage compartment, the compressor being releasably suspended within the tank and tank cavity liner including valve means for passing pressurized air from the compressor into the storage compartment whereby to maintain the pressurized air within the compartment upon withdrawal of the compressor from the tank liner. In the preferred form, a swash plate is connected to a drive shaft from a motor by an angled cam hub and bearing to translate rotational motion of the shaft into reciprocal motion of the swash plate with a plurality of pneumatic cylinders each including a piston driven by a piston connecting rod connected to the swash plate, and means for connecting a first end of the piston connecting rod to the periphery of the swash plate which includes means for rotating the first end of the piston connecting rod about a first axis substantially perpendicular to the drive axis and means for rotating the first end of the piston connecting rod about a second axis substantially perpendicular both to the first axis and drive axis. The connecting means is further characterized by a plurality of U-shaped slots on the periphery of the swash plate for connecting the first ends of the piston rods wherein the means for rotating the first end of each piston rod about a first axis includes a pair of annular bearings positioned within a pair of openings in opposite sides of each slot and an axle having opposed ends seated within bearings in opposite sides of the slot to allow the axle to rotate about the first axis.

The above and other objects, advantages and features of the present invention will become more readily appreciated and understood from a consideration of the following detailed description of preferred and modified forms of the present invention when taken together with the accompanying drawings in which:

BRIEF DESCRIPTION OF THE DRAWINGS

FIG. 3 is a top view of the air tank taken substantially along the line 3—3 in FIG. 2;

FIG. 4 is an enlarged view partially in section of the compressor connected within the tank cavity, with portions broken away for clarity;

DETAILED DESCRIPTION OF PREFERRED EMBODIMENT

Figure 1:
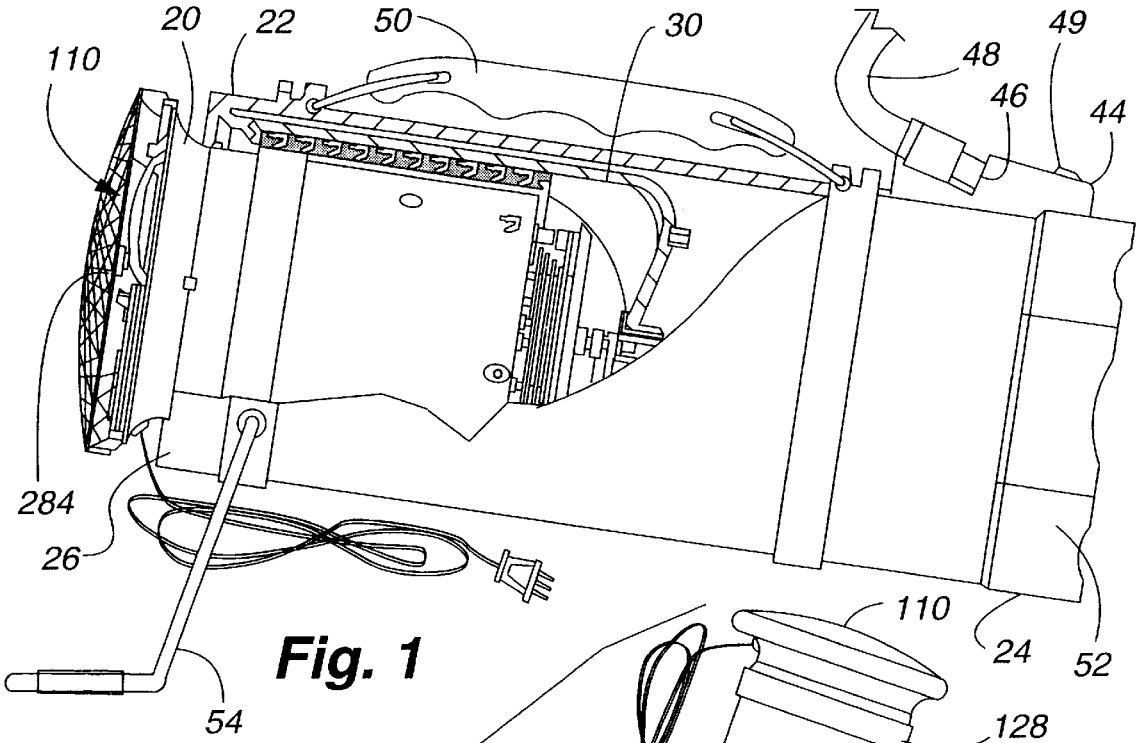
FIG. 1 is a side view in elevation of a preferred embodiment of a compressor, air tank and tank cavity liner in accordance with the present invention, portions broken away to show details of the compressor within the tank liner.
Figure 2:
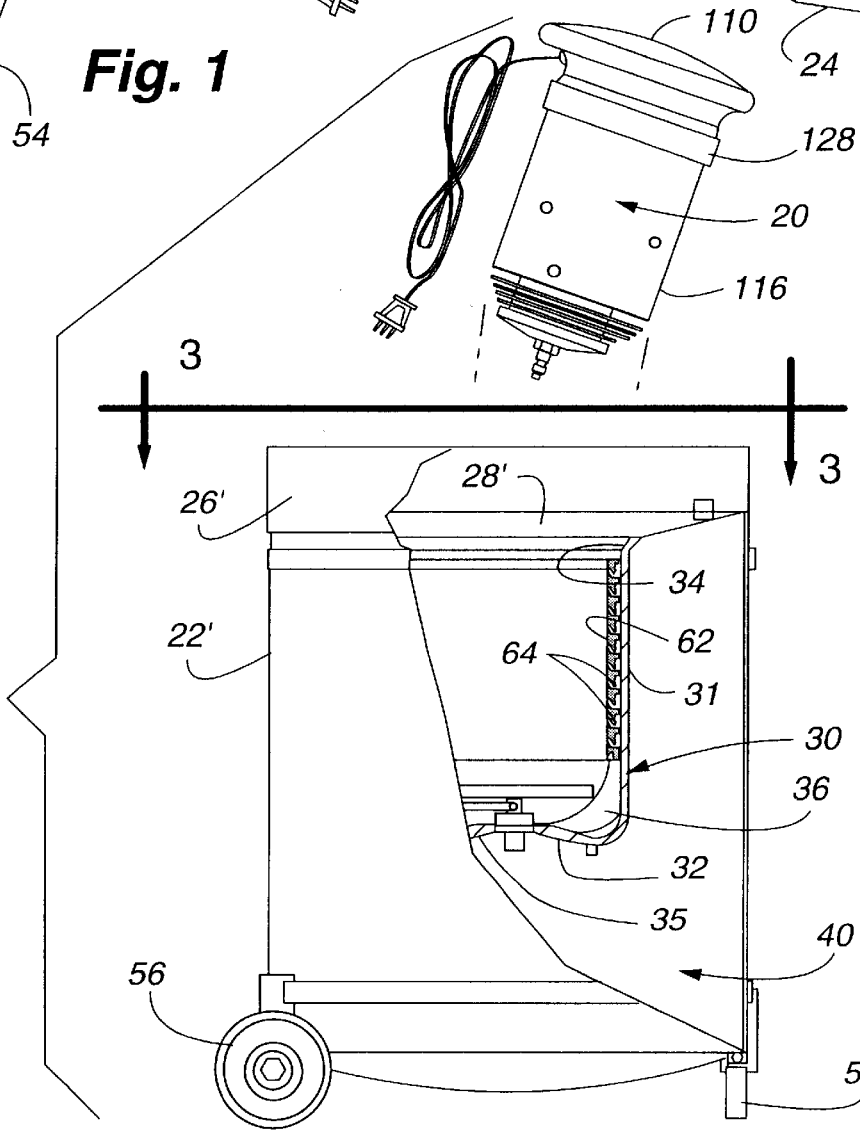
FIG. 2 is a side view in elevation of an alternative embodiment of the present invention illustrating the compressor shown in FIG. 1 withdrawn from an alternative air tank, with portions broken away to show details of a tank cavity liner of the present invention.

Referring in more detail to the drawings, as shown in FIGS. 1 and 2, a preferred form of an air compressor system includes a compressor assembly 20 detachably mounted within an air tank assembly 22. The tank assembly 22 is preferably cylindrical in shape and includes a closed bottom end 24 and a top end 26 defining an opening therein for receiving a tank liner 30. The tank liner 30 preferably comprises a cylindrical sleeve or sidewall 31 having a closed bottom end 32 and an open top which terminates in a flared, circular lip 34, FIG. 4. Once the tank liner 30 is inserted within the assembly 22, the lip 34 of the liner 30 is welded or similarly attached to a periphery of the assembly 22 to securely suspend the liner 30 within the interior of the tank assembly 22, as shown in FIGS. 1 and 2.

The bottom end 32 of the tank liner 30 is preferably curved and includes a raised central portion 35, as shown in FIG. 2. The bottom end 32 also preferably includes a plurality of curved vanes 36 which extend from a point along the cylindrical sidewall 31 down to the curved bottom end 32 before terminating at the raised central portion 35, the vanes 36 being composed of a rubber or rubber-like material of limited flexibility. FIG. 3 illustrates that six vanes 36 are preferably equidistantly arranged about the bottom end 32 for a purpose described in greater detail below.

The bottom end 32 of the tank liner 30 also includes a mechanism for releasably attaching and supporting the compressor assembly 20, described in greater detail below, as well as a check valve 38 for directing high pressure air generated by the compressor assembly 20 to an interior storage compartment 40, FIG. 2, of the air tank assembly 22. The storage compartment 40 of the tank assembly 22 essentially comprises the entire volume of the tank which falls outside of and beneath the tank liner 30. A chamber 44 mounted on an external surface of the tank assembly 22 includes an access port 46 for attachment of a conventional air hose 48. The chamber 44 is in direct communication with the interior storage compartment 40 of the tank assembly 22 so that the high pressure air within the tank assembly 22 may be accessed via the hose 48. The lowest portion of the chamber 44, when placed in a vertical orientation, includes a port 49 for draining water which condenses out of the compressed air within the storage compartment 40 of the tank assembly 22.

The tank assembly 22 shown in FIG. 1 represents one of a variety of different air tanks which may be beneficially used with the compressor assembly 20 of the present invention. For instance, the tank assembly 22 is relatively small and portable, and preferably includes a carrying handle 50. Additionally, an octagonal rubber boot 52 is preferably fitted over the bottom end 24 of the tank assembly 22 to prevent the tank assembly 22 from rolling and to help absorb any vibrations which may be transferred from the compressor assembly 20 to the tank assembly 22. The boot 52 also allows the tank assembly 22 to be placed on a support surface in either a vertical position or a horizontal position, preferably with the aid of a support stand 54 as shown in FIG. 1. However, a significant feature of the present invention is the ability to transfer the compressor assembly 20 between different air tanks, such as, between the relatively small tank assembly 22 shown in FIG. 1 and the larger tank assembly 22' shown in FIG. 2 to successively pressurize each tank.

The tank assembly 22' includes wheels 56 and support legs 58 to allow the tank assembly 22' to be rolled along a support surface since the tank assembly 22' is too large to be lifted by a handle in the manner of the smaller tank assembly 22 shown in FIG. 1. Other than its size, the larger tank assembly 22' is functionally similar to the smaller tank assembly 22 and includes an identical tank liner 30 fitted within the opening within the top end 26' of the tank assembly 22'. FIG. 2 illustrates that the compressor assembly 20 may be fitted within the tank liner 30 in the same manner as shown with the tank assembly 22 in FIG. 1.

While details of the connection of the compressor assembly 20 within the tank liner 30 are provided below, it is significant that the same compressor assembly 20 may be removed from the tank liner 30 of the first tank assembly 22, FIG. 1, and placed within the tank liner 30 of the second tank assembly 22' (FIG. 2). Furthermore, due to the inclusion of the check valve 38 between the tank liner 30 and the tank interior storage compartment 40, a single compressor assembly 20 may be used to fill the storage compartment 40 of one tank, such as the tank assembly 22', and then be removed for use with another tank, such as, the smaller portable tank assembly 22, while the tank assembly 22' remains pressurized and ready for use.

For purposes of describing the connection of the compressor assembly 20 within the tank liner 30, reference will hereafter be made to the tank assembly 22, although it is understood that an identical connection is made within the larger tank assembly 22'. As shown in FIGS. 1–4, the tank liner 30 preferably includes a muffler sleeve 62 which covers a substantial portion of an interior surface of the cylindrical sidewall 31 of the tank liner 30. The muffler sleeve 62 is conventional in design and preferably comprises a plurality of baffles or ports 64 which allow for the passage of air into the liner 62. A filler material such as fiberglass is preferably positioned between the liner 62 and the sidewall 31 of the tank liner 30 to muffle the sound of any air passing through the liner 62.

An air chuck or releasable coupling 66 is attached at the raised central portion 35 of the bottom end 32 of the tank liner 30 at the junction of the six vanes 36, as shown in FIG. 3. The air chuck 66 receives a high pressure stem 67 of the compressor assembly 20 to releasably secure the compressor assembly 20 within the tank liner 30, as described in greater detail below, and to provide a passageway for high pressure air from the compressor assembly 20 to fill the storage compartment 40 of the tank assembly 22. The check valve 38 preferably communicates with the air chuck 66 to prevent the high pressure air within the storage compartment 40 from passing back through the air chuck 66 when the compressor assembly 20 stops operating. In the preferred embodiment, the spring loaded check valve 38 provides a force equivalent to approximately 1–2 p.s.i. so that the passageway between the air chuck 66 and the interior storage compartment 40 of the tank assembly 22 is opened only when the pressure generated by the compressor assembly 20 is 1–2 p.s.i. greater than the pressure of the air within the tank 22. Thus, the check valve 38 closes when a selected set pressure is reached within the tank assembly 22 and the compressor assembly 20 stops operating to prevent the pressurized air from flowing out of the storage compartment 40 and back into the compressor assembly 20.

The air chuck 66 is supported atop a vibration isolating insert 69 which is mounted on the raised central portion 35 of the bottom 32 of the tank liner 30. Therefore, the weight of the compressor assembly 20 is supported within the tank liner 30 by connection of the high pressure stem 67 within the air chuck 66. Additionally, the insert 69 preferably houses the check valve 38 which allows high pressure air to pass from the stem 67 into the storage compartment 40 of the tank assembly 22 as described above. The vibration isolating insert 69 further includes a rubber seal 72 surrounding the check valve 38 to reduce the transmission of vibrations from the stem 67 of the compressor assembly 20 to the tank liner 30 and thus to the tank assembly 22.

In order to detach the compressor assembly 20 from the tank liner 30, the air chuck 66 is actuated by downward motion of a lever arm 74 pivotably attached at one end to one of the vanes 36 adjacent to the cylindrical sidewall 31 of the tank liner 30, as shown in FIGS. 3 and 4. An opposite end of the lever arm 74 is divided into two forked ends 76, FIG. 3, which attach to opposite sides of the air chuck 66 for activating the air chuck 66. An upper extension ring 77 includes a mounting end 78 which is attached to the lever arm 74, as best shown in FIG. 4. The extension ring 77 further includes a downwardly extending member 80 which contacts a cam surface 82 on the lever arm 74 so that downward movement of the ring 77 tends to push the lever arm 74 downwardly and activate the quick-release mechanism on the air chuck 66. A top surface of the extension ring 77 opposite the pivot point 75 of the arm 74 includes a contact pad 84, as shown in FIGS. 3 and 4. A release rod 86 is arranged for vertical extension along the wall 116 of the compressor assembly 20 with a return spring 87 at its lower end which allows for limited downward movement of the rod 86. An upper end 89 of the rod 86 protrudes above the cover 110 so that, when depressed, an enlarged portion 88 engages the contact pad 84 and pushes the pad 84 downwardly to pivot the arm 74 and activate the air chuck release mechanism. The position of the rod 86 and the contact pad 84 on the opposite side of the tank liner 30 from the pivot point 75 of the lever arm 74 maximizes the moment applied to the arm 74 and thus reduces the force which must be exerted by the rod 86 to activate the release mechanism within the air chuck 66.

The compressor assembly 20 broadly comprises a motor within a housing 100 which drives a plurality of pistons 102 to compress air within a plurality of pneumatic cylinders 104. The compressed air is expelled through exhaust valves 106 into a high pressure manifold 108 which, in turn, directs the air through the high pressure air stem 69 connected to the interior storage compartment 40 of the tank assembly 22 via the air chuck 66. A cover 110 attached above the motor 100, FIG. 4, includes a fan 112 for forcing ambient air to the bottom of the compressor assembly 20 for cooling purposes as well as to supply pre-pressurized air to the intake valves 114 of the cylinders 104.

Cylindrical side wall 116, preferably made from a translucent plastic material, is attached to an end plate 118 of the motor housing 100 by a first set of vibration dampening bolts 120, FIG. 4. A second set of vibration dampening bolts 122 connects a bottom portion of the wall 116 to a cylinder head 124, as described in greater detail below. The wall 116 thus surrounds the majority of the compressor assembly 20 and defines an air space for directing the air pushed by the fan 112 toward the bottom 32 of the tank liner 30. The curved vanes 36 in the bottom 32 of the tank liner 30 help to direct the air toward the intake valves 114 at the bottom of the compressor assembly 20 while also promoting turbulent air flow within the bottom of the tank liner 30. In this manner, the fan 112, the wall 116, and the vanes 36 act as a first stage compressor by pre-compressing the ambient air and directing that air through the intake valves 114 to fill the air cylinders 104 during an intake stroke of the pistons 102. Additionally, the curved vanes 36 aid in guiding the compressor assembly 20 through the tank liner 30 by contacting the bottom portion of the wall 116 and centering the compressor assembly 20 to align the high pressure stem 67 with the air chuck 66.

A circular rubber seal 128 is preferably positioned about an upper portion of the wall 116, as shown in FIGS. 1 and 4. When the compressor assembly 20 is loaded within the tank liner 30, the seal 128 contacts the muffler 62 to support the compressor assembly 20 against lateral movement within the tank liner 30. In this manner, the compressor assembly 20 effectively floats within the tank liner 30 with the only points of positive contact being that of the high pressure stem 67 within the air chuck 66 and the contact between the rubber seal 128 and the muffler sleeve 62. This floating support system works in conjunction with the vibration dampening bolts 120 and 122 as well as the rubber seal 96 within the air chuck 66 to minimize the transmission of vibrations from the compressor assembly 20 to the tank assembly 22.

The rubber seal 128 additionally works in conjunction with the muffler sleeve 62 to quiet the operation of the compressor assembly 20 while it is positioned within the tank liner 30. As the fan 112 directs intake air downwardly through the wall 116 to the intake valves 114, excess intake air, which does not pass through the intake valves 114 and into the cylinders 104, returns upwardly between the wall 116 and the muffler sleeve 62 toward the top of the tank liner 30 where it is exhausted to the ambient air outside of the tank assembly 22. The rubber seal 128 thereby acts to block the direct exhaust path of the excess intake air and forces the excess air through the plurality of ports 64 within the muffler sleeve 62 to muffle the noise of the excess air before exhausting it to the atmosphere outside of the tank liner 30.

Figure 5A:
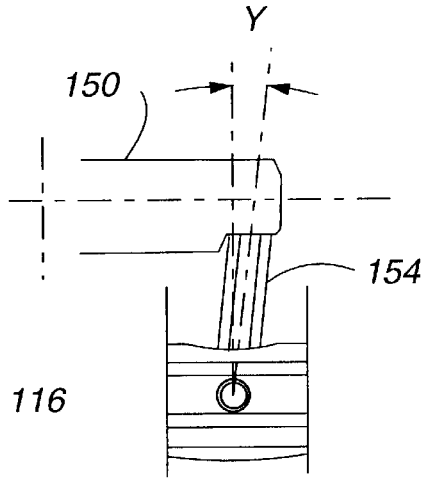
FIG. 5A is another view in detail of the piston shown in FIG. 5 illustrating the piston at the midpoint of its vertical stroke within the cylinder.
Figure 5:
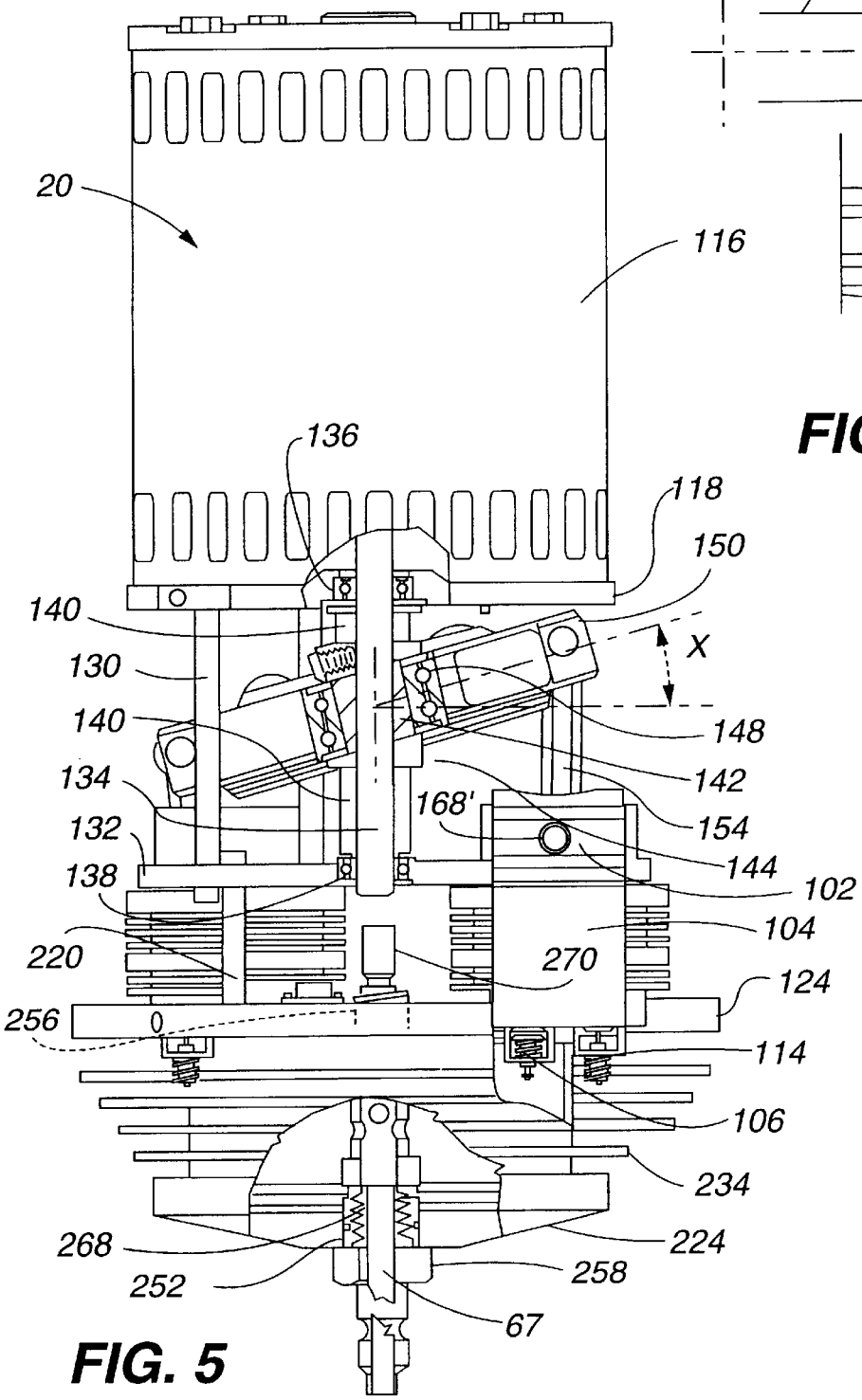
FIG. 5 is an enlarged view partially section in elevation of the compressor shown in FIG. 4, with portions broken away for clarity, illustrating a piston at its maximum upward position within its respective cylinder.

In addition to the interchangeability of the compressor assembly 20 to be able to fit within different air tanks, and the unique system for mounting the compressor assembly 20 within the tank liner 30 to reduce both noise and the vibrations which are transferred to the tank assembly 22, the compressor assembly 20 employs a unique swash plate design which minimizes wear on piston rods and the pistons 102 within the cylinders 104 without the use of oil or other lubricants. As best shown in FIG. 5, a plurality of support rods 130 connect the motor end plate 118 to an intermediate base plate 132. A drive shaft 134 extends through the motor end plate 118 and is rotatably supported by bearings 136 and 138 disposed within the motor end plate 118 and the intermediate base plate 132, respectively. Spacers 140 positioned along the shaft 134 are used to precisely position an angled cam hub 142 on the shaft 134. A set screw 144 secures the angled cam hub 142 to the drive shaft 134 to ensure the cam hub 142 rotates together with the drive shaft 134. An outer periphery of the angled cam hub 142 is secured to an inner race of a thrust bearing 148 to allow the inner race to rotate with the cam hub 142. A static outer race of the bearing 148 is securely press fit within a central opening of a swash plate 150. The combination of the angled cam hub 142 and the thrust bearing 148 ensures that a point along a periphery of the swash plate 150 will oscillate up and down in a figure-8 pattern without rotating about the drive shaft 134. Thus, when piston rods 154 are attached to the periphery of the swash plate 150, the swash plate 150 operates to convert the rotational motion of the drive shaft 134 into a reciprocating motion of the piston rods 154. The reciprocating action of the swash plate 150 causes the piston rods 154 to undergo a minimal angular deflection from the vertical thereby enhancing the efficiency of the compressor assembly 20 while reducing the stress on the connecting rods 154, pistons 102 and the cylinders 104.

Figure 6:
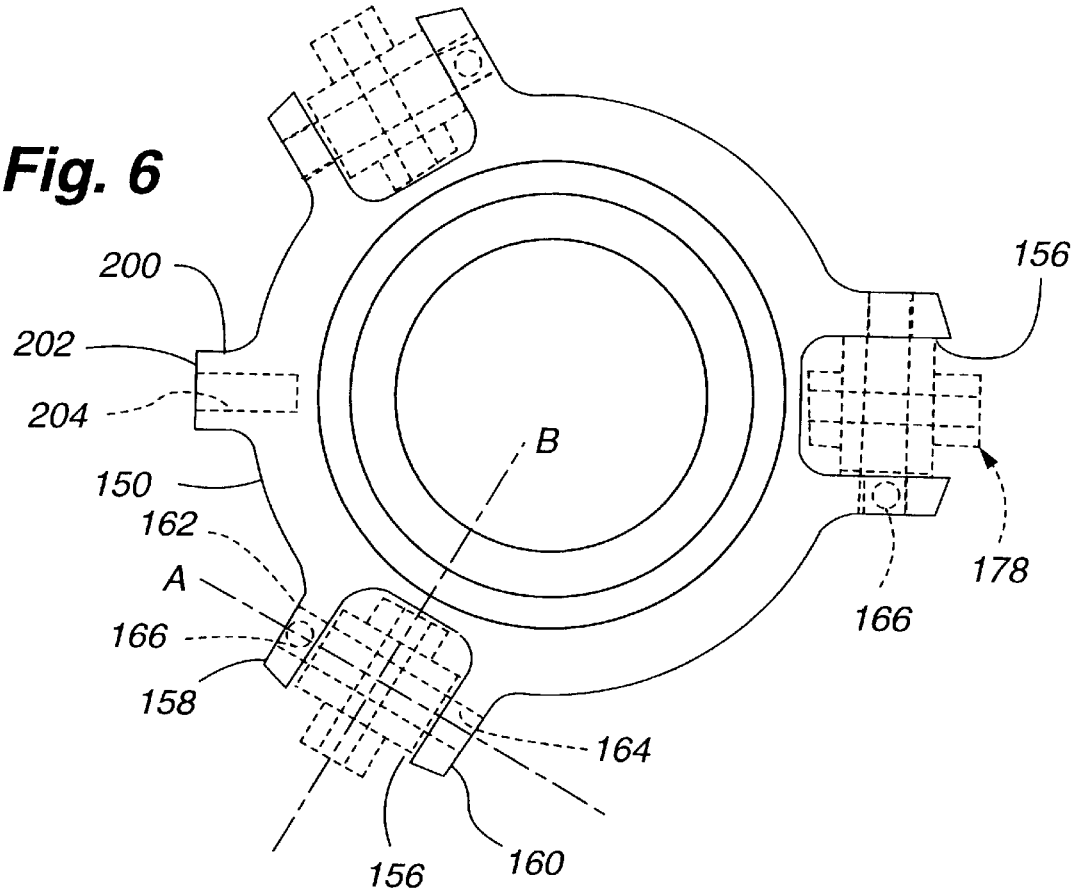
FIG. 6 is a top view of a swash plate of the present invention with three connecting rod joint assemblies shown in phantom.

The swash plate 150, shown in detail in FIG. 6, comprises a metal disc which includes a plurality of U-shaped slots 156 formed between radial arms 158 and 160 at spaced circumferential intervals. Lateral holes 162 and 164 are drilled perpendicularly through the arms 158 and 160, respectively, and a vertical hole 166 is formed through the bottom of the arm 158. Each slot 156 receives a unique two-way joint assembly 168, FIG. 7, for connecting a first end 170, FIG. 8, of the piston rod 154 to the swash plate 150. The number of U-shaped slots 156 corresponds to the number of pneumatic cylinders 104 which are employed within the compressor assembly 20, although an odd number of cylinders 104 is preferred. Three cylinders 104 are illustrated in the preferred embodiment of the invention, and thus three U-shaped slots 156 are shown in FIG. 6.

Figure 7:
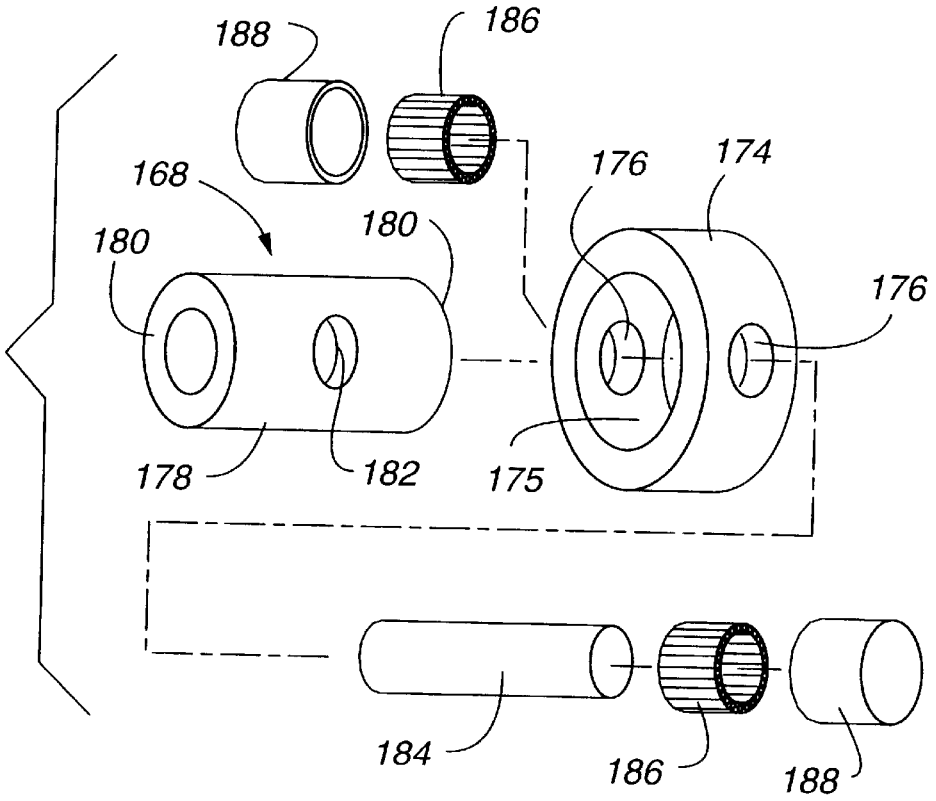
FIG. 7 is an exploded view of the connecting rod joint assembly shown in FIG. 6.

FIG. 7 illustrates the preferred embodiment of the two-way joint assembly 168 which fits within each U-shaped slot 156 of the swash plate 150. The two-way joint assembly 168 comprises a ring 174 having a central opening 175 and a pair of opposing holes 176 formed within the cylindrical wall of the ring 174. A tube 178 is inserted through the central opening 175 of the ring 174 and has an outside diameter substantially equal to the diameter of the central opening 175 of the ring 174 to provide a close fit between the tube 178 and the ring 174. Additionally, the tube 178 is longer than the ring 174 so that opposing ends 180 of the tube 178 extend beyond the corresponding ends of the ring 174. Furthermore, the tube 178 includes a pair of opposing holes 182 which are aligned with the holes 176 when the tube 178 is inserted through the ring 174. An elongated rod 184 is inserted through the two pairs of holes 176 and 182 within the ring 174 and the tube 178, respectively. The diameter of the rod 184 is substantially the same as the diameter of the holes 176 and 182 to provide an interference fit between the rod 184 and the ring 174 as well as the tube 178. Additionally, the elongated rod 184 is sufficiently long to allow opposing ends 185 of the rod 184 to protrude from the holes 176 and extend beyond the outer circumference of the ring 174. Needle bearings 186 fit over the protruding ends 185 of the rod 184, and end caps 188 are press fit over the needle bearings 186 to allow the rod 184, as well as the attached ring 174 and tube 178, to rotate relative to the end caps 188. The end caps 188 are then press fit within the lateral holes 162 and 164 of the swash plate arms 158 and 160, respectively. A set screw, not shown, is threaded into the vertical hole 166 within the arm 158 to secure the end cap 188 and allow the two-way joint assembly 168 to rotate on the needle bearings 186 about an elongated central axis A, FIG. 6, of the rod 184.

Figure 8:
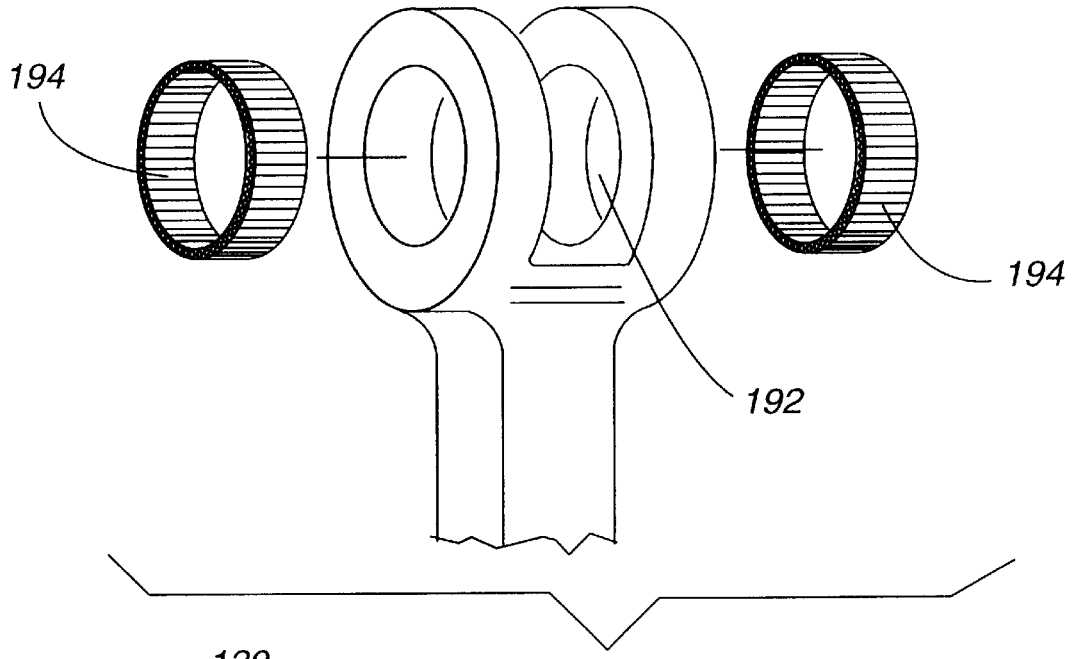
FIG. 8 is an exploded view of one end of a connecting rod of the present invention.

As shown in FIG. 8, the first end 170 of the piston rod 154 is split into two circular ends 190 which are separated by a distance substantially equal to the width of the ring 174.

Each circular end 190 includes an interior opening 192 within which needle bearings 194 are positioned. The circular ends 190 and the needle bearings 194 are then press-fit over the ends 180 of the tube 178 to allow the circular ends 190 to rotate relative to the tube 178 about an elongated central axis B through the tube 178. The B axis about which the ends 190 rotate is substantially perpendicular to the A axis about which the entire two-way joint assembly 168 rotates. Thus, the end 170 of the piston rod 154 is able to move about two perpendicular axes A and B, and this freedom of movement allows the piston rod 154 to move naturally in response to the figure-8 motion of the periphery of the swash plate 150 without relying on relatively fragile ball and socket connections. The connection of the lower end of the piston rod 154 to the piston 102 is correspondingly a two-way joint assembly 168' of the same type but on a smaller scale as the upper end of the piston rod 154 and is connected into the standard wrist pin centrally of the piston 102.

In effect, as the periphery of the swash plate 150 reciprocates in response to the rotation of the drive shaft 134, the U-shaped slots 156 tend to move along an arc which extends both toward and away from the drive shaft 134. Thus, the first end 170 of the piston rod 154 must rotate about the A axis to compensate for the back and forth lateral motion of the periphery of the swash plate 150. This rotation about the A axis is accomplished by rotation of the entire two-way joint assembly 168 on the rod 184. An example of this rotation is shown in FIGS. 5 and 5A. FIG. 5 illustrates the rightmost piston 102 at the top of its stroke where the angle x is at its maximum value and where the piston rod 154 is substantially vertically aligned with its corresponding cylinder 104. FIG. 5A depicts the swash plate 150 and the piston rod 154 where the piston 102 is at the midpoint of its stroke so that the angle x is zero. FIG. 5A further illustrates how the periphery of the swash plate 150 and thus the U-shaped slot 156 follows an arcuate path downward to push the first end 170 of the piston rod 154 farther away from the drive shaft 134. In essence, the arcuate motion of the slot 156 pushes the first end 170 of the piston rod 154 out of vertical alignment with the cylinder 104, as depicted by the angle y in FIG. 5A, thereby requiring the two-way joint assembly 168 to rotate about the A axis to compensate for the lateral displacement of the end 170. A second end, not shown, of the piston rod 154 is preferably attached to the piston 102 via a conventional wrist pin 198, FIGS. 4 and 5, to allow the second end of the piston rod 154 to rotate in unison with the first end 170 about an axis which is parallel to the A axis.

In addition to the above-described lateral displacement of the first end 170 of the piston rod 154, the wavy, figure-8 motion of the swash plate periphery also causes the U-shaped slots 156 to roll about the B axis as the slots 156 reciprocate in the vertical direction. To compensate for this rolling motion and reduce the stress applied to the piston rods 154, the needle bearings 192 allow the circular ends 190 of the piston rod 154 to rotate about the ends 180 of the tube 178 as the tube 178 rolls about the B axis. An example of this rotation is shown in FIG. 4 wherein the center piston rod 154 is shown within a vertical plane, even though the corresponding U-shaped slot 156 has rolled about the B axis which extends into the page perpendicular to the drive shaft 134. The ability of the piston rod end 170 to rotate on the needle bearings 194 about the B axis thus allows the piston rod 154 to counteract the rolling motion of the swash plate 150 and maintain the piston rod 154 in the vertical plane so that the rod 154 may efficiently drive the piston 102. Thus, the rolling motion of the swash plate 150 does not apply a bending force to the piston rod 154 as would occur if a conventional wrist pin were used in place of the two-way joint assembly 168.

In summary, the two-way joint assembly 168 enables freedom of movement for the first end 170 of the piston rod 54 about two perpendicular axes A and B, both of which are mutually perpendicular to the axis of the drive shaft 134, to allow the swash plate 150 to drive the pistons 102 while minimizing or eliminating bending stresses on the piston rods 154. Furthermore, the two-way joint assembly 168 provides a stronger and more durable connection than prior art ball and socket connections, and the use of the needle bearings 186 and 194 allows the joint assembly 168 to operate without lubricants.

Figure 9:
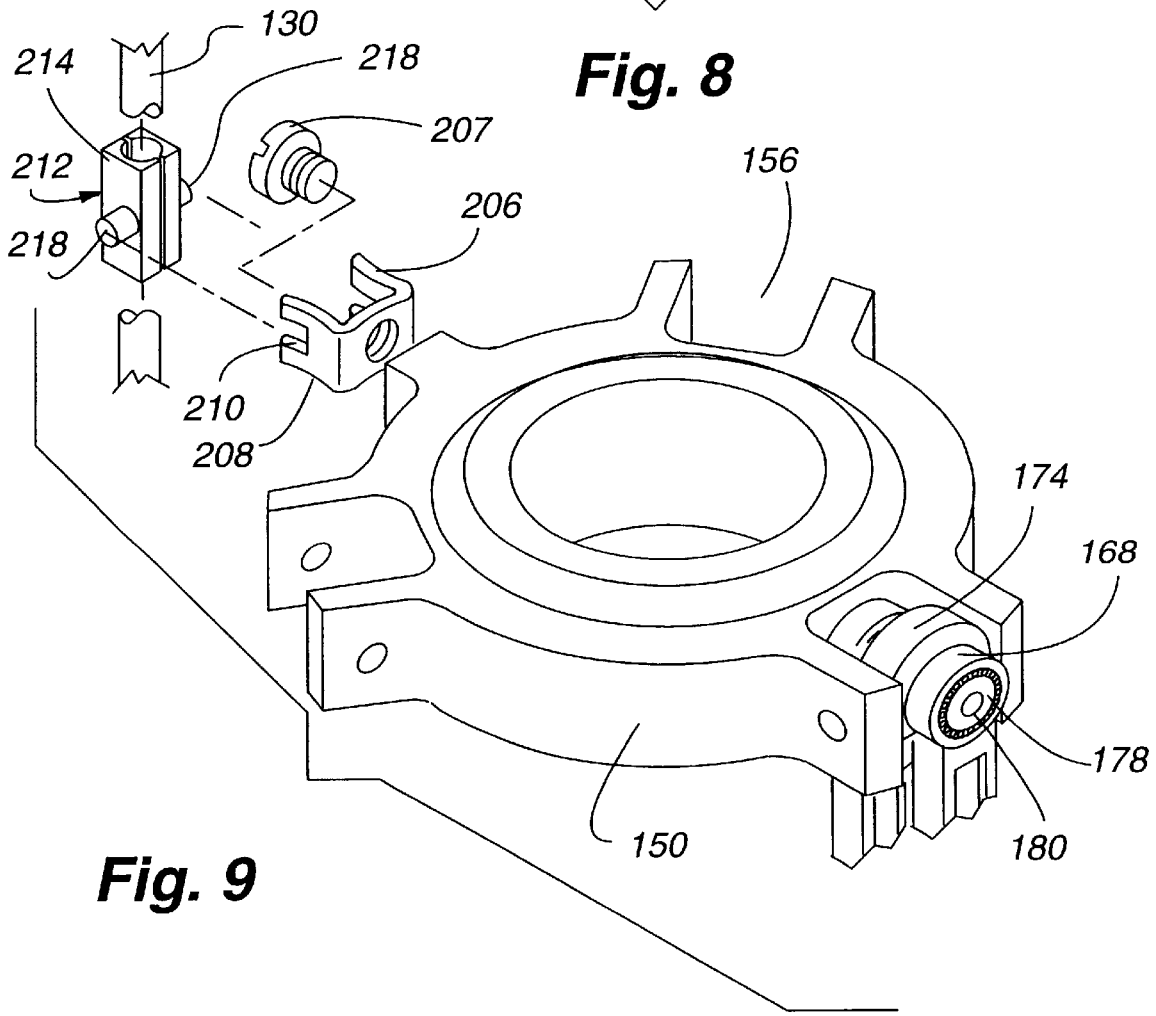
FIG. 9 is a perspective view illustrating the attachment of the connecting rod joint assembly to the swash plate shown in FIG. 6 in addition to an exploded view of a linear slider which is also attached to the swash plate.

As shown in FIG. 6, in addition to the three U-shaped slots 156, the periphery of the swash plate 150 includes a projection 200 positioned midway between two of the slots 156. The projection 200 includes a flat surface 202 facing away from the swash plate 150. A threaded hole 204 is formed within the flat surface 202 as shown in FIG. 6. FIG. 9 illustrates a fork 206 which is preferably attached to the projection 200 by a fastener 207 which allows the fork 206 to rotate relative to the flat surface 202 of the projection 200 about an axis extending through the hole 204. The fork 206 preferably includes two pairs of arms 208 which define opposing slots 210. The fork 206 is preferably made from spring steel and the opposing pairs of arms 208 are preferably formed with facing convex bends to predispose the pairs of arms 208 toward one another. Furthermore, the projection 200 is preferably located on the swash plate 150 so that one of the support rods 130 passes between the two pairs of arms 208 to allow attachment of a linear slider 212 between the fork 206 and the rod 130, as shown in FIG. 9.

The linear slider 212 preferably comprises a split bushing 214 having two identical halves which define a substantially cylindrical interior surface 216 to receive the support rod 130 and allow the bushing 214 to slide freely along the support rod 130. The bushing 214 is easily press-fit between the opposing pairs of arms 208 due to the spring steel construction and the bent nature of the arms 208. The bushing 214 further includes two pins 218, one extending from each half of the bushing 214, which are sized to fit within the opposing slots 210 of the fork 206.

Connected in this manner, the linear slider 212 moves up and down the support rod 130 with the reciprocating motion of the swash plate 150 while maintaining the position of the swash plate relative to the cylinders 104, thereby preventing any rotation of the swash plate 150 about the axis of the drive shaft 134 due to friction within the thrust bearing 148. The ability of the fork 206 to pivot relative to the projection 200 allows the fork 206 to compensate for the rolling motion of the swash plate 150. Additionally, the length of the slots 210 allows the pins 218 to move back and forth within the slots 210 to compensate for the back and forth lateral motion of the swash plate periphery. Furthermore, the use of the spring steel fork 206 and the split bushing 214 establishes the necessary play to prevent the linear slider 212 from binding as it moves along the rod 130 without the aid of any lubricant. Thus, the rotating fork 206 and the linear slider 212 combine to further reduce the stress on the piston rods 154 by maintaining proper alignment between the U-shaped slots 156 of the swash plate 150 and their respective cylinders 104.

FIG. 5 illustrates that a second set of support rods 220 attach the cylinder head 124 to the intermediate base plate 132 while leaving sufficient space to hold under pressure the cylinders 104 between the intermediate base plate 132 and the cylinder head 124 for an airtight seal. Additionally, the manifold 108 is shown in inverted position in FIG. 10 wherein three recessed areas 224, shown in phantom, are formed in a top surface of the cylinder head 124 to mate with the bottom ends of the three cylinders 104. The cylinder head 124 also includes three threaded holes 226 formed laterally within the sidewall of the cylinder head for receiving the vibration dampening bolts 122 that attach the wall 116, as described above.

Figure 10:
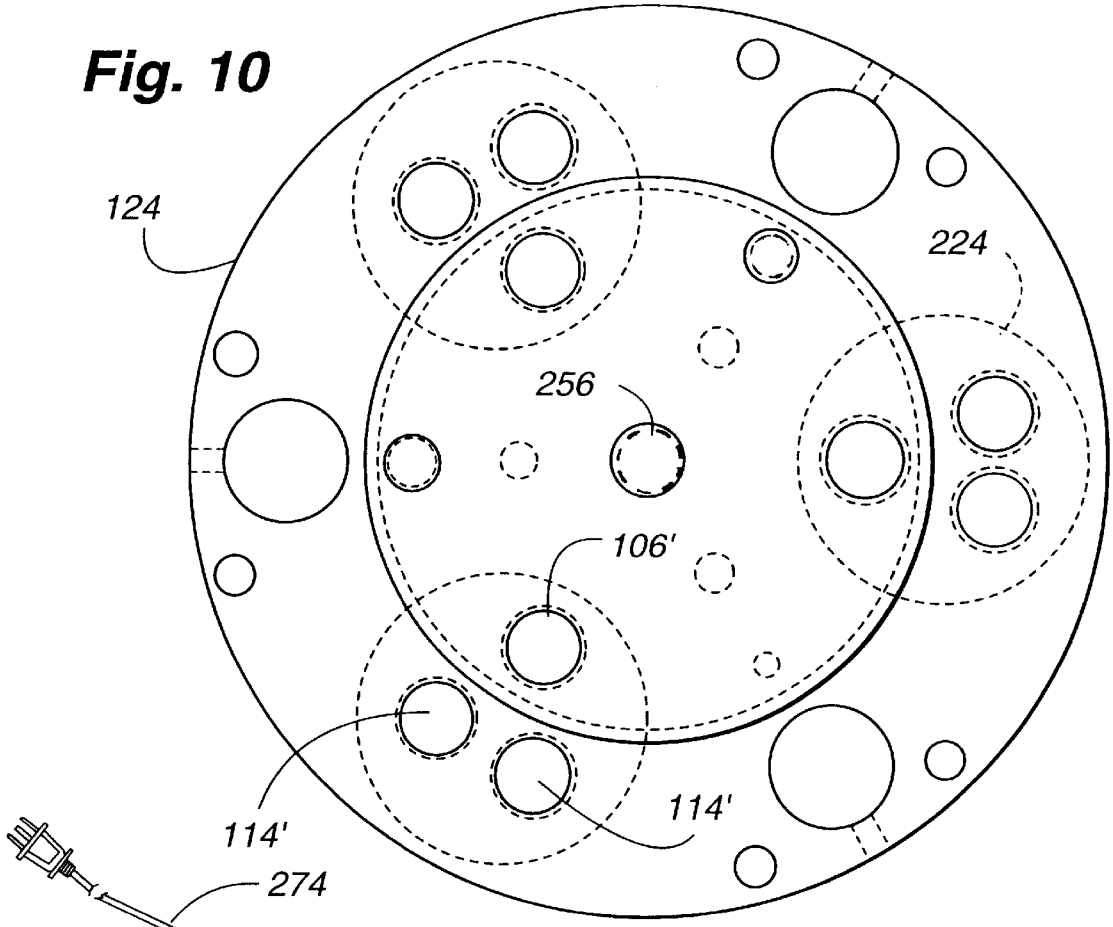
FIG. 10 is a bottom plan view of the cylinder head.
Figure 11:
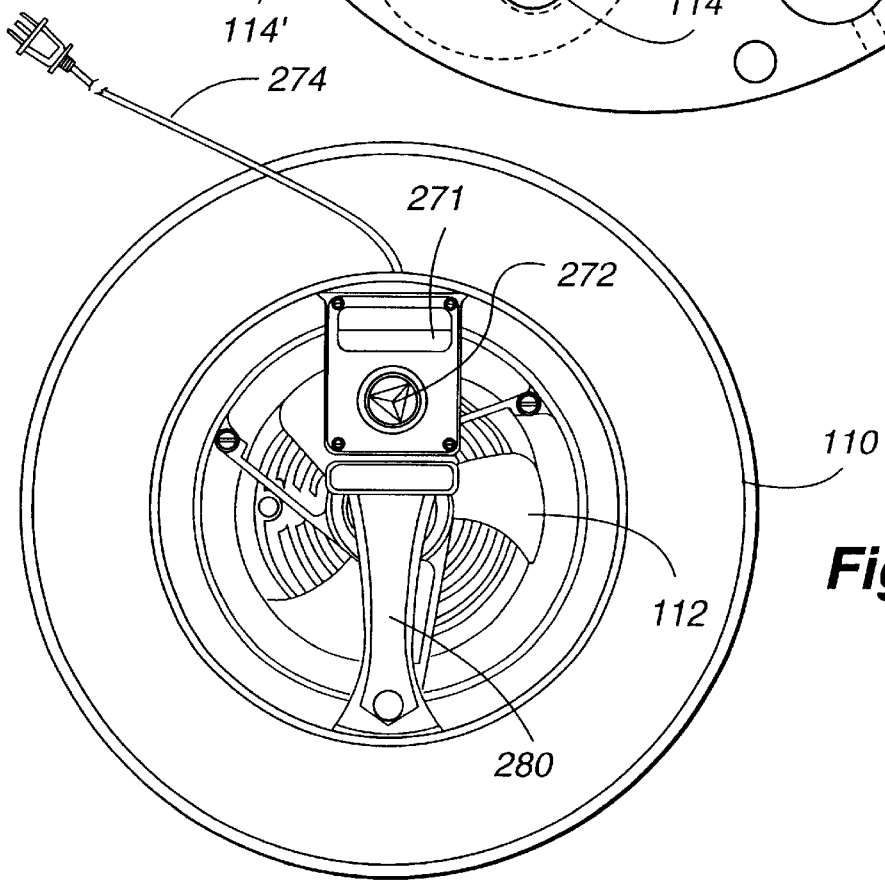
FIG. 11 is a top plan view of the cover portion of the compressor.
Figure 12:
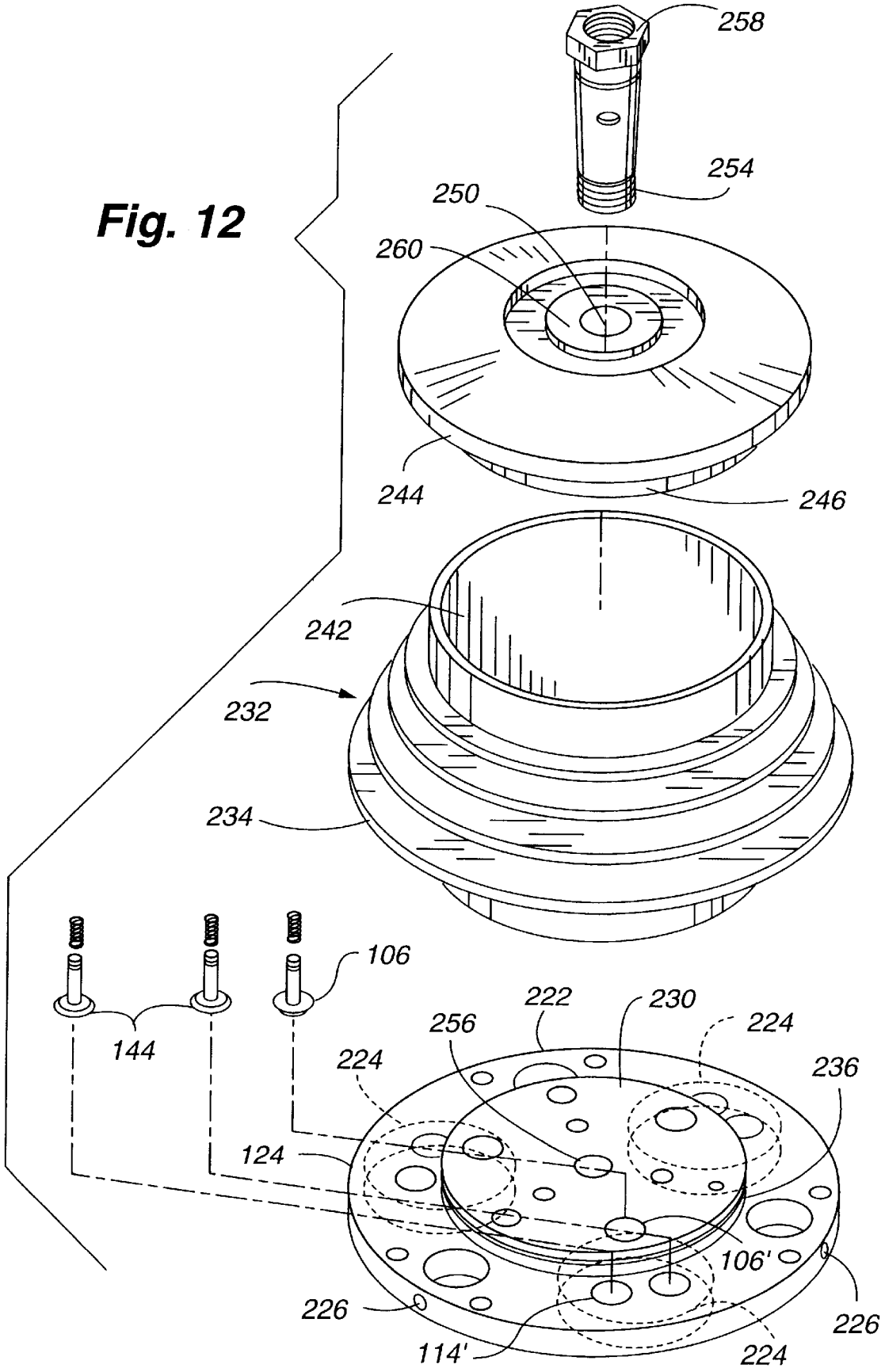
FIG. 12 is an exploded view of a cylinder head and manifold of the present invention.

FIG. 10 further illustrates that the bottom surface 222 of the cylinder head 124 includes a raised circular portion 230 for seating the high pressure manifold 108. The manifold 108 essentially comprises a hollow cylinder 232 having a plurality of cooling fins 234 attached to an exterior surface thereof. The circular seat 230 is of a smaller diameter than that of the cylinder head 124, and an outer periphery of the seat 230 includes an o-ring 236 for forming an air-tight seal with a first end 238 of the cylinder 232. A second end 242 of the cylinder 232 mates with a cover 244 to close the manifold 108. An interior face of the cover 244 includes a protruding circular disc 246 containing an o-ring, not shown, to form an air-tight seal at the second end 242 of the cylinder 232.

The cover 244 further includes a central opening 250 for receiving a high pressure pipe 252. The pipe 252 includes a threaded end 254 which is inserted through the central opening 250 and threaded into a central hole 256 which extends through both the cylinder head 124 and the circular seat 230. A second end of the pipe 252 includes a nut 258 for contacting a mating surface 260 on an exterior surface of the manifold cover 244 to secure the manifold cover 244 to the bottom surface 222 of the cylinder head 124, see FIG. 5.

As further shown in FIG. 5, each cylinder 104 includes two intake valves 114 and one exhaust valve 106. The exhaust valves 106 are inserted via bore 106' within the perimeter of the circular seat 230 on the bottom surface 222 of the cylinder head 124 so that high pressure air being exhausted from the cylinders 104 will be contained within the high pressure manifold 108 which surrounds the seat 230. In turn, each of the intake valves 114 accesses the cylinder 104 via bores 114' within the recessed area 224 which falls outside of the perimeter of the circular seat 230 so that the intake valves 114 are free to access the cooling air which passes outside of the manifold 108 and is directed to the bottom of the tank liner 30 by the fan 112.

Thus, the intake valves 114 and the exhaust valves 106 for each cylinder 104 open and close sequentially as the piston 102 is driven within the cylinder 104 by the swash plate 150. Specifically, the two intake valves 114 open as the piston 102 is drawn upwardly to allow air to fill the cylinder 104. The air passing through the intake valves 114 is at a slightly higher pressure than the ambient air due to the effect of the fan 112, as described above. This increase in pressure helps to force the intake valves 114 open as the piston 102 is pulled away from the valves 114. As the piston 102 reaches the top of its stroke within the cylinder 104, the intake valves 114 close and the piston 102 starts its downward stroke to compress the air within the cylinder 104. The exhaust valve 106 opens on the downward stroke to allow the compressed air within the cylinder 104 to pass through both the cylinder head 124 and the circular seat 230 and into the high pressure manifold 108.

The pipe 252 securing the manifold 108 to the cylinder head 124 is preferably open at both ends and includes an access port 264 to allow high pressure air within the manifold 108 to fill the pipe 252. The pipe 252 is internally threaded for securing a threaded end 268 of the high pressure stem 90 thereby allowing the stem 90 to communicate with the manifold 108. The stem 90 is thus secured against the nut 258 as shown in FIG. 5 to support the weight of the compressor assembly 20 once the stem 90 is inserted within the air chuck 66. Thereafter, pressurized air entering the manifold 108 from each of the exhaust valves 106 in succession will pass through the pipe 252 and the high pressure stem 90. Once the air pressure within the manifold 108 is high enough to open the check valve 38, the pressurized air within the manifold 108 will pass into the storage compartment 40 of the tank assembly 22 as described above. Should the air pressure within the manifold 108 drop below that in the tank assembly 22, the check valve 38 closes to preserve the relatively high air pressure within the tank assembly 22.

A pressure sensor 270 atop the cylinder head 124, FIG. 5, is threaded into a top portion of the central hole 256 adjacent to the upper end of the pipe 252 which is threaded into the bottom of the hole 256. The pressure sensor 270 is thus exposed to the pressurized air within the manifold 108 which fills the pipe 252, and the sensor 270 is electrically connected to a dial 271 on the cover 110 which displays pressure readings and, through suitable control circuitry, not shown, acts as a pressure regulator to maintain a desired level of air pressure within the manifold 108. Thus, a user may set a control knob 272 on the cover 110 to a desired pressure and the control circuitry will activate the motor in housing 100 to drive the swash plate 150 and fill the manifold 108 with pressurized air. Once the pressure within the manifold 108 reaches the set pressure, as detected by the sensor 270, the control circuitry will halt the operation of the compressor assembly 20 until the pressure within the manifold 108 falls below the desired pressure, such as, when air is drawn from the tank assembly 22 through the hose 48.

In addition to regulating the operation of the compressor assembly 20, the pressure sensor 270 includes an unloading valve, not shown, which automatically empties or removes the pressure from the manifold 108 once the set pressure is reached so that the compressor is not under pressure when it is released from the tank liner 30. Reducing the pressure within the manifold 108 in this manner eases start-up of the compressor assembly 20 by reducing the force which must be applied to the pistons 102 to force open the exhaust valves 106. Furthermore, the compressor assembly 20 also preferably includes one or more temperature sensors 273 which monitor temperatures at the cylinder head 124, the motor 100, and possibly other areas. The temperature sensors 273 work with the control circuitry to shut the compressor off when predetermined temperature limits are exceeded.

As noted above, the cover 110 contains the control knob 272 and further provides a mount for the fan 112. Additionally, the cover 110 receives a power cord 274 for operating the electric motor 100 as well as powering the pressure regulator control circuitry. The cover 110 is preferably fixed to the wall 116 by fasteners 276. The top end 89 of the release rod 86 also protrudes through the cover 110 for convenient actuation of the release mechanism. Furthermore, the cover 110 includes a handle 280 adjacent the end 278 of the release rod 86 so that a user may press the end 278 with his or her thumb while grasping the handle 280 and withdrawing the compressor assembly 20 from the tank liner 30. In this manner, the compressor assembly 20 may be conveniently transferred between different tanks 22, 22' as described. Additionally, the cover 110 may include a screen 284 which serves to filter the ambient air directed by the fan 112 to the bottom of the tank liner 30, while simultaneously providing a protective cover for the control knob 272 and other indicators on the top of the cover 110.

In summary, the air compressor system of the present invention includes a powerful swash plate air compressor capable of achieving pressures as high as 175 p.s.i. for extended duty cycles. The unique two-way joint assembly 168 which connects the piston rod 154 to the swash plate 150, as well as the linear slider 212 which maintains the proper position of the swash plate 150, combine to allow the compressor assembly 20 to achieve such relatively high pressures without lubrication and without straining the piston rods 154 or excessively wearing the pistons 102 and cylinders 104.

The system of the present invention also utilizes identical tank liners 30 within different sized air tanks and configurations to allow a single compressor to be successively connected to different air tanks and therefore fit into different spaces. Additionally, the unique suspension system for supporting the compressor assembly 20 within each tank liner 30 minimizes the transmission of vibrations from the compressor assembly 20 to the tank assembly 22. Furthermore, the inclusion of a muffler sleeve 62 within each tank liner 30 promotes quiet operation of the compressor. Thus, due to the minimal vibrations and noise produced by the air compressor system of the present invention, the combination of the compressor assembly 20 and tank assembly 22 may be used in nearly any environment or application. The present invention thus represents a vast improvement over prior air compressors which can not achieve the versatility by way of the compact construction and interchangeable nature of the compressor system. Furthermore, prior swash plate compressors lack the unique two-way joint assembly 168 of the present invention and thus do not demonstrate the power and durability of the present compressor assembly 20.

It is therefore to be understood that while preferred and modified forms of the present invention are herein set forth and disclosed, other modifications and changes may be made therein without departing from the spirit and scope of the present invention as defined by the appended claims.

I claim:

1. An air compressor system, comprising:

a compressor for generating pneumatic pressure;

at least one air tank including a top end and a bottom end connected to define an interior air space between said top and bottom ends, said top end defining an opening to permit access to said interior air space; and a tank liner including a bottom wall and at least one side wall, said tank inserted through said opening and mounted within said interior air space to define a storage compartment between said tank and said liner, said liner releasably receiving said compressor and supporting said compressor within said air space, and valve means for delivering pressurized air from said compressor into said storage compartment whereby to maintain said pressurized air within said storage compartment upon withdrawal of said compressor from said liner.

2. An air compressor system according to claim 1 wherein a plurality of said tanks are identical to said at least one air tank, said compressor being selectively and interchangeably connectable to each of said tanks.

3. An air compressor system according to claim 2, wherein said compressor is operative to successively fill said storage compartment of each said tank, said valve means of each said tank being operative to maintain said pressurized air within said storage compartment of each said respective tank upon disconnection of said compressor therefrom.

4. An air compressor system according to claim 3, wherein each said tank includes discharge valve means for selective removal of pressurized air from said tank.

5. An air compressor system according to claim 1, wherein said compressor is provided with blower means for directing ambient air into said liner whereby to cool said compressor during operation.

6. An air compressor system according to claim 5, wherein said compressor is provided with a plurality of pneumatic cylinders having intake and exhaust valves associated with each of said cylinders, and said blower means is operative to direct ambient air into said cavity under sufficient pressure to open said intake air valve means at a predetermined pressure level.

7. An air compressor system according to claim 6, wherein said compressor further includes an outer wall surrounding said motor and said cylinders, and vibration mounts between said outer wall and said cylinders.

8. An air compressor sy stem according to claim 7, wherein said compressor includes a seal in surrounding relation to said outer wall and a muffler sleeve.

9. An air compressor system according to claim 8, wherein said seal and said muffler sleeve cooperate to prevent excess intake air from passing between said outer wall and said muffler and to direct said excess intake air through said muffler sleeve prior to expelling said excess intake air to the atmosphere.

10. An air compressor system according to claim 1, wherein a side wall of said liner is cylindrical in shape and said muffler is attached to an interior surface of said side wall, said outer wall is cylindrical in shape to define an annular space between said muffler and said outer wall; and said seal fills a portion of said annular space to prevent said excess intake air from passing through said annular space.

11. An air compressor system according to claim 1, wherein said valve means includes a vibration isolating insert to reduce vibrations passing from said compressor to said liner.

12. An air compressor system according to claim 1, wherein said release means is provided for separating said valve means from said compressor; a lever arm attached to said valve means for activating said release means; and said compressor includes an extendable release handle for engaging said lever arm and actuating said release means to remove said compressor from said liner.

13. An air compressor system according to claim 12, wherein said release means includes an extension arm connected to said lever arm to increase a moment applied to said lever arm; and said release handle engages said extension arm.

14. A pneumatic compressor system, comprising:

a compressor for generating pneumatic pressure including a high pressure manifold and a valve stem at one end;

at least one air tank including a top end and a bottom end connected to define an interior air space between said top and bottom ends, said top end defining an opening to permit access to said interior air space; and a tank cavity liner including a bottom wall and at least one side wall, said liner inserted through said opening and mounted within said interior air space to define a storage compartment between said tank and said cavity, said tank cavity liner releasably receiving said compressor and supporting said compressor within said air space, and releasable coupling means including a check valve into which said valve stem is inserted for delivering pressurized air from said manifold into said storage compartment whereby to maintain said pressurized air within said storage compartment upon withdrawal of said compressor from said liner.

15. A pneumatic compressor system according to claim 14, wherein said tank includes discharge valve means for selective removal of pressurized air from said storage compartment; and wherein said compressor is provided with a plurality of pneumatic cylinders having intake and exhaust valve means associated with each of said cylinders, and blower means is operative to direct ambient cooling air into said liner under sufficient pressure to open said intake air valve means at a predetermined pressure level.

* * * * *